US009777625B2

(12) United States Patent
Bruestle

(10) Patent No.: US 9,777,625 B2
(45) Date of Patent: Oct. 3, 2017

(54) RECIPROCATING INTERNAL COMBUSTION ENGINE

(71) Applicant: Neander Motors AG, Kiel (DE)

(72) Inventor: Claus Bruestle, Nordheim (DE)

(73) Assignee: Neander Motors AG, Kiel (DE)

( * ) Notice: Subject to any disclaimer, the term of this patent is extended or adjusted under 35 U.S.C. 154(b) by 126 days.

(21) Appl. No.: 14/812,044

(22) Filed: Jul. 29, 2015

(65) Prior Publication Data

US 2016/0032819 A1 Feb. 4, 2016

(30) Foreign Application Priority Data

Jul. 30, 2014 (DE) ..... 10 2014 011 355

(51) Int. Cl.
*F02B 61/04* (2006.01)
*B63H 20/00* (2006.01)
(Continued)

(52) U.S. Cl.
CPC ..... *F02B 61/045* (2013.01); *B63H 20/002* (2013.01); *F01M 11/08* (2013.01);
(Continued)

(58) Field of Classification Search
CPC .... F02B 61/045; F02B 75/007; F02B 75/065; F02B 75/32; B63H 20/002; F01M 11/08; F01M 13/04; F02M 13/0416
(Continued)

(56) References Cited

U.S. PATENT DOCUMENTS 4,667,647 A 5/1987 Ohtaka et al.
4,881,510 A * 11/1989 Etoh ..... F01M 9/10 123/196 W
(Continued)

FOREIGN PATENT DOCUMENTS

DE 35 09 439 C2 3/1988
DE 10 2006 038 831 A1 2/2008
(Continued)

OTHER PUBLICATIONS

European Search Report issued in counterpart European Application No. 15002144.2 dated Dec. 15, 2015 with partial English translation (five pages).

*Primary Examiner* — Marguerite McMahon
(74) *Attorney, Agent, or Firm* — Crowell & Moring LLP

(57) ABSTRACT

A reciprocating internal combustion engine includes at least one piston, which is operatively connected by two connecting rods having two crankshafts rotating in opposite directions and running parallel to each other, which crankshafts are oriented in an upright manner to a horizontal water line of a boat, and an internal combustion engine housing of the internal combustion engine is composed of at least a cylinder crank housing and a cylinder head, having inlet and outlet valves, and is bounded by an upper end face and a bottom end face. To optimize the internal combustion engine, a joint ventilation system has an oil separating device provided with an oil pre-separator and a main oil separator, via which, when operating the internal combustion engine, a mixture of oil and leaking gas, resulting in a crankcase of the cylinder crank housing, reaches, by way of a discharge line extending adjacent to the upper end face, the oil pre-separator, from where the mixture of oil and leaking gas is led into the main oil separator and there is separated into the components of oil and leaking gas. The oil flows into an oil pan connecting at the bottom end face and the leaking
(Continued)

gas near the upper end face flows into an intake system of the internal combustion engine.

19 Claims, 6 Drawing Sheets

(51) Int. Cl.

| | |
|---|---|
| ***F01M 11/08*** | (2006.01) |
| ***F02B 75/00*** | (2006.01) |
| ***F02B 75/32*** | (2006.01) |
| ***F01M 13/04*** | (2006.01) |
| ***F02B 75/06*** | (2006.01) |

(52) U.S. Cl.
CPC ..... *F01M 13/04* (2013.01); *F01M 13/0416* (2013.01); *F02B 75/007* (2013.01); *F02B 75/065* (2013.01); *F02B 75/32* (2013.01)

(58) Field of Classification Search
USPC ..... 123/572–574, 196 W, 195 HC
See application file for complete search history.

(56) References Cited

U.S. PATENT DOCUMENTS

| | | | | |
|---|---|---|---|---|
| 5,794,602 | A * | 8/1998 | Kimura | F01M 13/04 123/572 |
| 6,035,836 | A * | 3/2000 | Watanabe | F02B 61/045 123/572 |
| 6,308,695 | B1 | 10/2001 | Watanabe et al. | |
| 7,201,132 | B2 * | 4/2007 | Miyake | F02B 75/007 123/195 HC |
| 2005/0092267 | A1 * | 5/2005 | Nonaka | F01M 13/0416 123/41.86 |
| 2008/0245321 | A1 * | 10/2008 | Ishizaka | F01M 13/04 123/41.86 |
| 2013/0306043 | A1 * | 11/2013 | Spix | F01M 13/0416 123/572 |
| 2014/0041385 | A1 | 2/2014 | Wittwer | |
| 2016/0032819 | A1 | 2/2016 | Bruestle | |

FOREIGN PATENT DOCUMENTS

| | | |
|---|---|---|
| DE | 10 2012 015 907 B3 | 10/2013 |
| EP | 2 980 374 A1 | 2/2016 |

* cited by examiner

RECIPROCATING INTERNAL COMBUSTION ENGINE

CROSS REFERENCE TO RELATED APPLICATION

This application claims priority under 35 U.S.C. §119 from German Patent Application No. 10 2014 011 355.8, filed Jul. 30, 2014, the entire disclosure of which is herein expressly incorporated by reference.

BACKGROUND AND SUMMARY OF THE INVENTION

The invention relates to a reciprocating internal combustion engine, for example, in the form of an outboard engine for a boat.

An internal combustion engine acting as an outboard engine in a boat is known from publication EP 10 2012 015 907 B3, which includes two pistons working in a cylinder crank housing. Each piston is, by means of two connecting rods, coupled to two crankshafts rotating in opposite rotary directions. The crankshafts are disposed upright to the water line of the boat and influence a boat propeller for moving the boat. The internal combustion engine works according to the diesel process and has a diesel fuel injection system. A turbocharger device, which has an exhaust gas turbine and a compressor, is disposed at an upper end face of an internal combustion engine housing made up of a cylinder crank housing and a cylinder head. The latter is connected on the suction side of the internal combustion engine.

According to the publication, "A NEW CONCEPT FOR THE OUTBORD MARKET: Speech by Claus Brüstle on Oct. 8, 2013 at the 22$^{nd}$ Aachen Colloquium Automobile and Engine Technology," the internal combustion engine therein described exhibits future-oriented, technical features and provides economic market opportunities. This internal combustion engine is based on the construction principle as illustrated in the known publication EP 10 2012 015 907 B3.

Publication DE 35 09 439 C2 describes a device for ventilating a crankcase of an internal combustion engine for separating oil from a mixture of oil and leaking gas. Via passageways and a space of a ventilation mechanism of the cylinder head, the mixture of oil and leaking gas reaches a first chamber of an oil separator. A second chamber connects to the first chamber, and a control valve is provided between the first chamber and the second chamber.

A gas outlet channel leads from the second chamber to an intake system of the internal combustion engine.

Publication DE 10 2006 038 831 A1 concerns an internal combustion engine recycling blow-by gases in a closed-loop system. For this purpose, blow-by gases, starting from a crankcase of the internal combustion engine, are fed into an intake system of the internal combustion engine via flow channels each operatively connected to one another and formed in a cylinder crank housing, a cylinder block, and a cylinder head.

It is an object of the present invention to optimize a reciprocating internal combustion engine, for example, in the form of an outboard engine for a boat, including at least one piston, which, via two connecting rods, works together with two parallel, in the opposite-direction-rotating crankshafts disposed in an upright manner in the boat, in such a manner that specific measures to a great extent reduce pollutants, which are caused by a mixture of oil and leaking gas resulting from operating the internal combustion engine in an internal combustion engine housing, in a targeted manner.

This object is achieved according to the present invention by a reciprocating internal combustion engine, comprising at least one piston, which is operatively connected by means of two connecting rods having two crankshafts rotating in opposite directions and running parallel to each other, which crankshafts are oriented in an upright manner to a horizontal water line of the boat, wherein an internal combustion engine housing of the internal combustion engine is made up of at least a cylinder crank housing and a cylinder head, having inlet and outlet valves, and is bounded by an upper end face and a bottom end face, wherein the internal combustion engine has a joint ventilation system with the internal combustion engine housing, which has an oil separating device provided with an oil pre-separator and a main oil separator, via which, when operating the internal combustion engine, a mixture of oil and leaking gas, resulting, for example, in a crankcase of the cylinder crank housing, reaches, by way of a discharge line extending adjacent to the upper end face, the oil pre-separator, from where said mixture of oil and leaking gas is led into the main oil separator and there is separated into the components of oil and leaking gas, which oil flows into an oil pan connecting at the bottom end face and which leaking gas flows near the upper end face into an intake system of the internal combustion engine.

The main advantages achieved by the present invention are that the internal combustion engine, designed as an outboard engine and having at least one piston and two upright crankshafts, has a ventilation system having a highly efficient oil pre-separator and a main oil separator. They significantly contribute to protecting the environment, especially when using the outboard engine for boats in flowing and standing water. When operating the internal combustion engine, the mixture of oil and leaking gas, resulting, for example, in a crankcase, is led in a particularly efficient manner through said oil separator device and is separated into the components, that is, into oil and leaking gas. In this instance, the oil is fed to the oil pan and the leaking gas is fed into the intake system of the internal combustion engine. The mixture of oil and leaking gas is transported via the discharge line situated adjacent to the upper end face from the crankcase of the cylinder crank housing into the oil pre-separator, and, in order to simplify the architecture, the discharge line is placed at the outside of the internal combustion engine housing alongside the upper end face.

The function of the ventilation system or the oil separator device is expanded in that the mixture of oil and leaking gas is brought from the valve-camshaft area of the cylinder head into the oil pre-separator and the main oil separator via a first passageway. It is demonstrated in an exemplary manner that the oil pre-separator is provided with at least first and second upright guiding chambers separated by a guiding element, in which, in order to through-flow the mixture of oil and leaking gas, a second passageway is incorporated between the chambers adjacent to the bottom end face of the chamber of the internal combustion engine. An advantageous embodiment of the oil pre-separator is achieved when the mixture of oil and leaking gas in the first guiding channel is guided from the top to the bottom between the upper end face and the bottom end face alongside the guiding element and enters the second guiding chamber through the second passageway, via which said mixture of oil and leaking gas flows in the direction of the upper end face and from there reaches the main oil separator by inter-positioning a third passageway.

Measures are established when the oil pre-separator and the main oil separator are combined into a housing structure and when at least housing parts of the housing structure are mounted by means of holding screws to the cylinder head of the internal combustion engine housing. In this instance, it is to be additionally highlighted that the oil pre-separator and the main oil separator are put together by inter-positioning an annular spacer in such a manner that connecting planes run between the oil pre-separator and the spacer and between the spacer and the main oil separator and that the oil pre-separator, the spacer and the main oil separator are connected to one another by one or a plurality of connecting screws, which connecting screws adjacent to a rim zone of the housing structure are acting approximately perpendicular to the connecting planes. The design advantageously implements that the main oil separator is designed as a type of hood of the housing structure, which is led up to the spacer by a circumferential connecting rim.

A superior architecture is achieved in that the oil separator is provided with a labyrinth, along which the mixture of oil and leaking gas is guided, as a result of which the gas is, on one hand, separated in the direction of the intake system and, on the other, the oil in the direction of the oil pan. This is also supported in that the labyrinth has guide webs disposed at a distance from one another, which, starting from first and second upright, opposite sides, interlock in an alternating manner and which are situated in such a manner that separated oil of the mixture of oil and leaking gas is guided into recycling ducts in the direction of the oil pan. Finally, a well thought-through and simple construction is achieved, if the guide webs of the labyrinth are mounted at the inside of the hood of the main oil separator.

Other objects, advantages and novel features of the present invention will become apparent from the following detailed description of one or more preferred embodiments when considered in conjunction with the accompanying drawings.

DETAILED DESCRIPTION OF THE DRAWINGS

Figure 1:
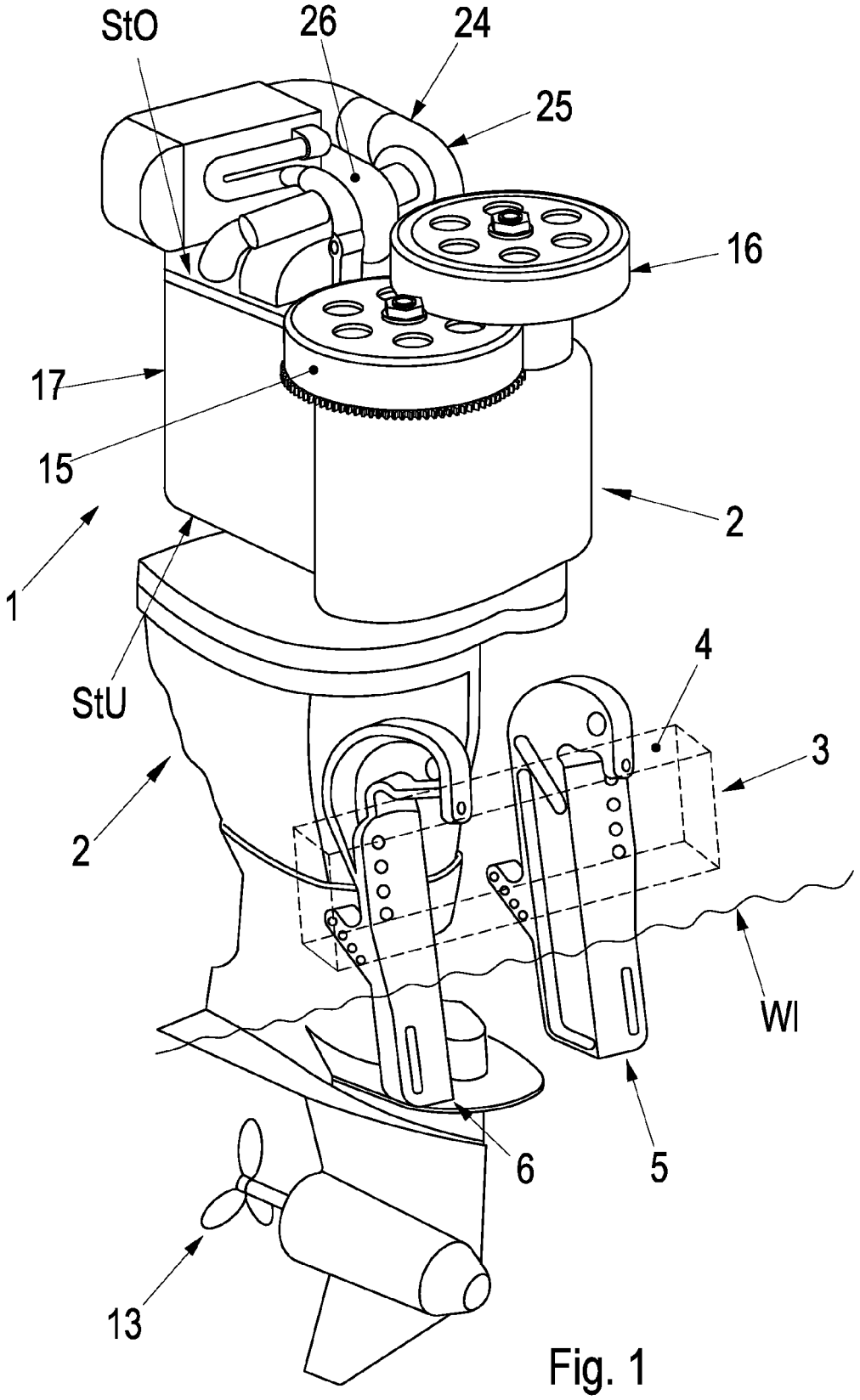
FIG. 1 shows a slanted view from the rear left side onto a reciprocating internal combustion engine, which is implemented as an outboard engine in a boat.
Figure 2:
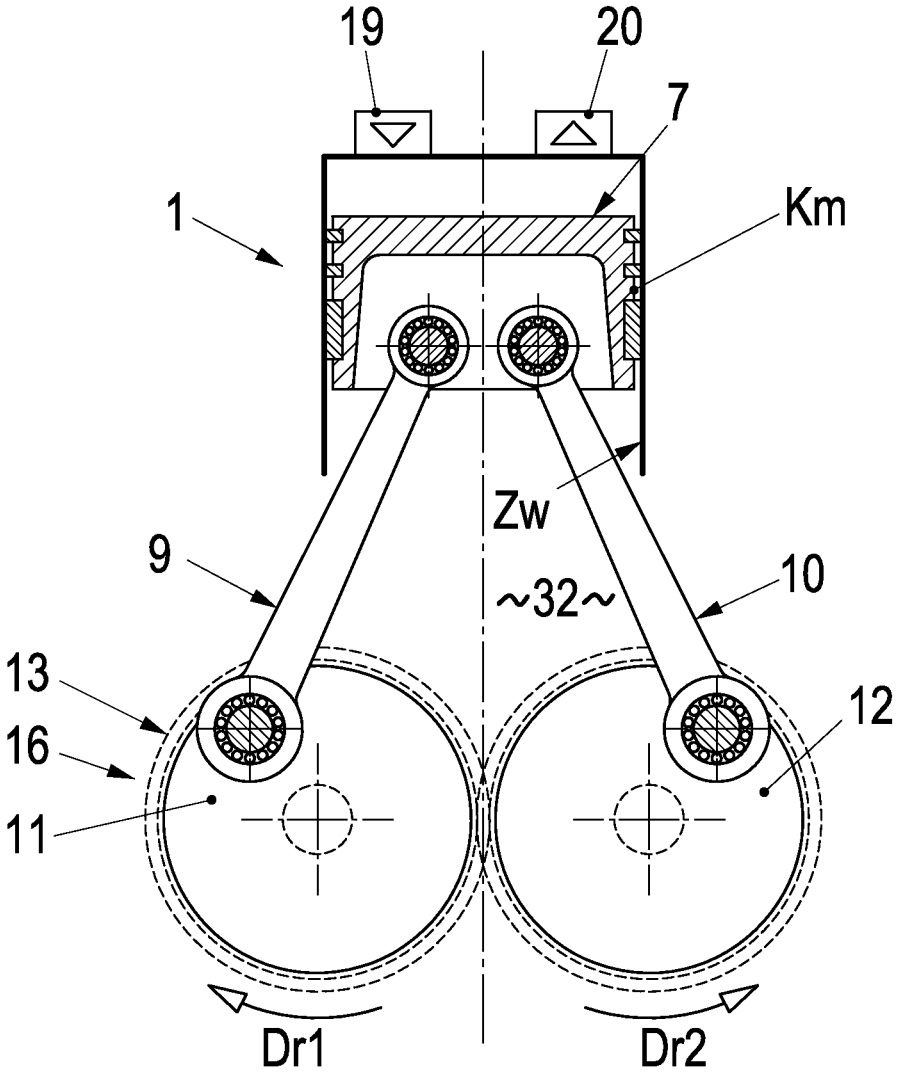
FIG. 2 shows schematically a cross section through the internal combustion engine according to FIG. 1 in the area of a piston, which is operatively connected by two crankshafts.

A reciprocating internal combustion engine 1 is designed as an outboard engine 2, actuating a boat 3. Boat 3 only shows a diagonal rear panel 4, at which outboard engine 2 is held in position by means of holding elements 5 and 6. Internal combustion engine 1 includes two pistons 7 and 8—FIG. 3—of which each piston, for example, piston 7, is operatively connected by means of two connecting rods 9 and 10—FIG. 2—to two crankshafts 11 and 12 extending in opposite directions of rotation Dr 1 and Dr2 and in a parallel manner to each other. Crankshafts 11 and 12 are disposed in an upright manner to the water line WI of boat 3 and actuate a boat propeller 13 working below water line WI—FIG. 1. On an opposite side of boat propeller 13, crankshafts 11 and 12 are provided with flywheels 15 and 16, which overlap in areas for the purpose of conserving space—FIG. 1.

An internal combustion engine housing 17 of internal combustion engine 1 is composed of a cylinder crank housing 18 receiving crankshafts 11 and 12 and a cylinder head 23 serving to accommodate inlet and outlet valves 19 and 20 and camshafts 21 and 22. Internal combustion engine housing 17 is bounded by an upper end face StO and a bottom end face StU—FIG. 1. Further, internal combustion engine 1 is working according to the diesel fuel injection method, and in order to improve the torque curve, fuel consumption and the exhaust gas emission values, an exhaust gas turbocharger device 24 is provided, which is mounted at upper end face StO. Exhaust gas turbocharger device 24—FIG. 1—is formed by an exhaust gas turbine 25 and a compressor 26, which is connected to an intake system 27—FIGS. 3 and 6—of internal combustion engine 1.

Figure 3:
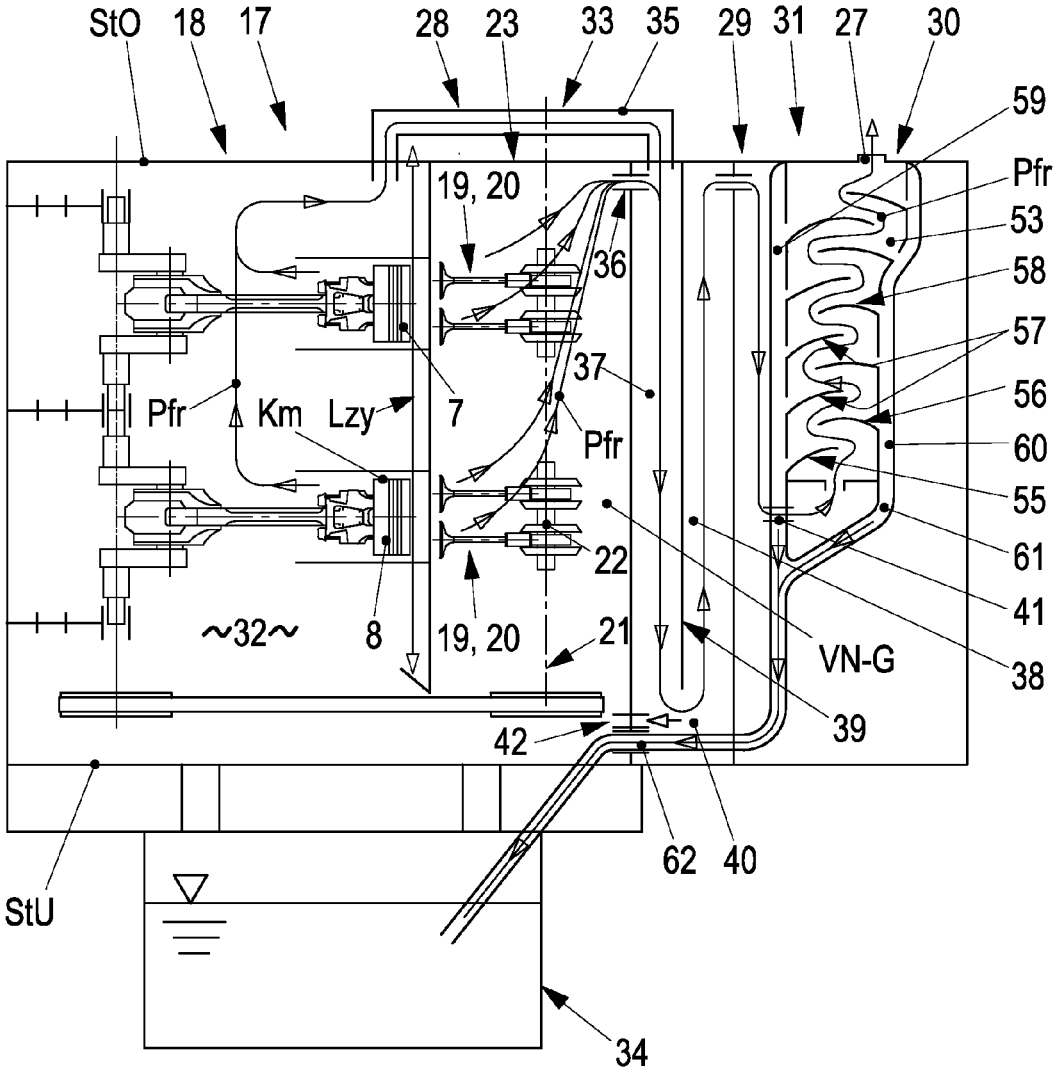
FIG. 3 shows a schematic longitudinal section of the internal combustion engine according to FIG. 1 having a ventilation system, including an oil separator device having an oil pre-separator and a main oil separator.

Internal combustion engine housing 17 is provided with a ventilation system 28, which has an oil separating device 31 having an oil pre-separator 29 and a main oil separator 30—FIG. 3—via which, when operating internal combustion engine 1, a mixture of oil and leaking gas resulting in a crankcase 32 of cylinder crank housing 18. The mixture of oil and leaking gas results from mixing gas—also known as blow-by gas—penetrating even under conditions of optimal sealing between piston skirt Km and cylinder wall Zw—FIG. 2—and smaller and larger oil drops, causing the movement of crankshafts 11 and 12 and connecting rods 9 and 10 in the crankcase.

Owing to the pressure conditions in crankcase 32, the mixture of oil and leaking gas reaches, by means of a discharge line 33 extending adjacent to upper end face StO, oil pre-separator 29, from where said mixture of oil and leaking gas is led into main oil separator 30. In main oil separator 30, this mixture is separated into the components of oil and leaking gas, and the oil flows into oil pan 34 connecting at bottom end face StU and the leaking gas flows near upper end face StO into intake system 27 or compressor 25. Discharge line 33 is formed by tube element 35, which is placed outside of internal combustion engine housing 17 alongside upper end face StO.

A mixture of oil and leaking gas in a valve-camshaft area VN-G, which results in a manner similar to the mixture of oil and leaking gas in crankcase 32, flows next to discharge line 33 or 35 running into oil pre-separator 29 via a first passageway 36 between cylinder head 23 and oil pre-separator 29 into said oil pre-separator.

Oil pre-separator 29 includes first and second guiding chambers 37 and 38 extending upright to water line WI, between which runs a flat guiding element 39. In order to through-flow the mixture of oil and leaking gas between first and second guiding chambers 37 and 38, a second passageway 40 is provided in guiding element 39. Guiding chambers 37 and 38 and guiding element 39 extend over a substantial length Lzy of cylinder head 23, and second passageway 40 is incorporated adjacent to bottom end face StU into guiding element 39. The mixture of oil and leaking gas in first guiding chamber 37 is guided from the top to the bottom between upper end face StO and bottom end face StU alongside guiding element 39 and enters, through second passageway 40, second guiding chamber 38, via which said mixture of oil and leaking gas flows in the direction of upper end face StO and from there reaches main oil separator 30 by inter-positioning third passageway 41. The oil extracted during this regulating of the mixture of oil and leaking gas flows back via a fourth passageway 42 into oil pan 34.

Figure 4:
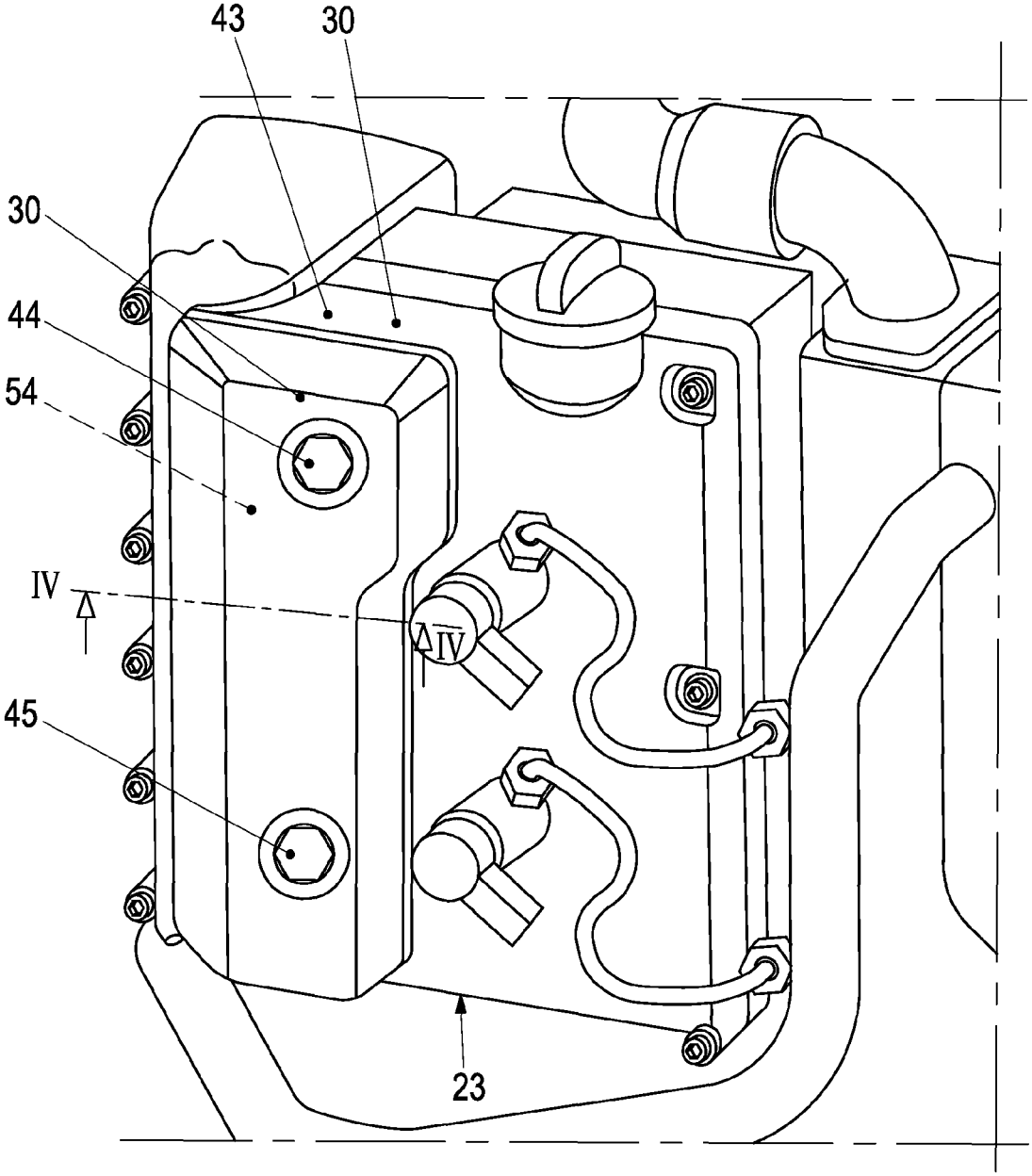
FIG. 4 shows a slanted view onto an internal combustion engine housing of the internal combustion engine having an oil separating device according to FIG. 3.
Figure 5:
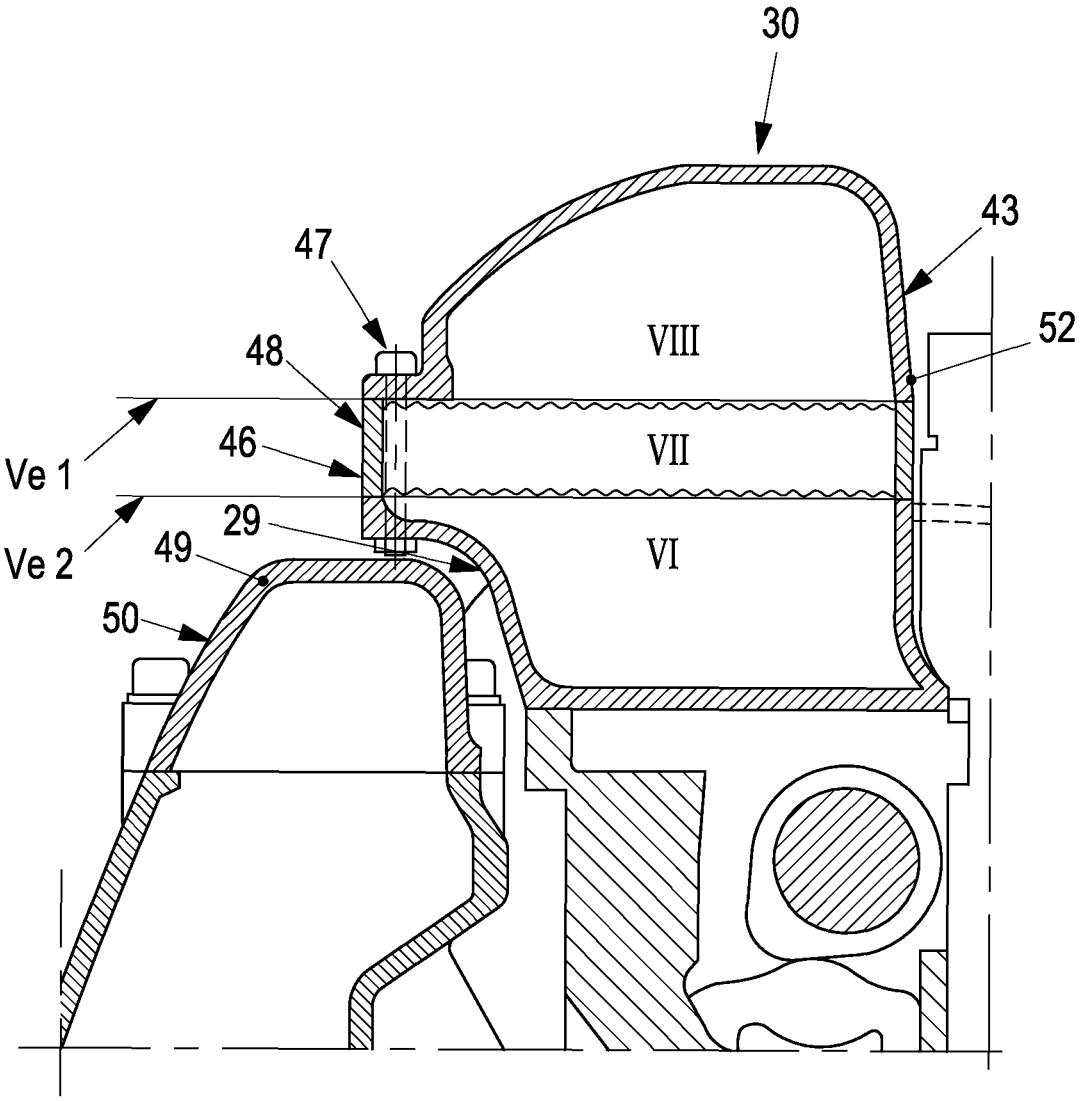
FIG. 5 shows a section according to line IV-IV of FIG. 4 on a larger scale.

Oil pre-separator 29 and main oil separator 30 are combined into a housing structure 43, by which at least the oil main separator 30 is held in position by means of holding screws 44 and 45 at cylinder head 23. In the exemplary embodiment—FIG. 4—oil pre-separator 29 is produced as one piece with cylinder head 23; however, it is also conceivable to design oil pre-separator 29 separately from cylinder head 23. Furthermore, oil pre-separator 29 and main oil separator 30 are put together at connecting planes Ve1 and Ve2 by inter-positioning an annular spacer 46. This component configuration enables an appropriate volume design—VI, VII and VIII—of oil pre-separator 29, of spacer 46 and of main oil separator 30 for a defined treatment of the mixture of oil and leaking gas. Oil pre-separator 29, spacer 46 and main oil separator 30 are joined via one or a plurality of connecting screws 47. Connecting screws 47 act adjacent to a rim zone 48 of housing structure 43 approximately perpendicular to the connecting planes Ve1 and Ve2. Below the one or plurality of connecting screws 47 runs an outer contour 49 of an air intake duct hood 50. Furthermore, main oil separator 30 is designed as a type of a lid 51 of housing structure 43 or of main oil separator 30, which is led up to spacer 46 by a circumferential connecting rim 52.

Figure 6:
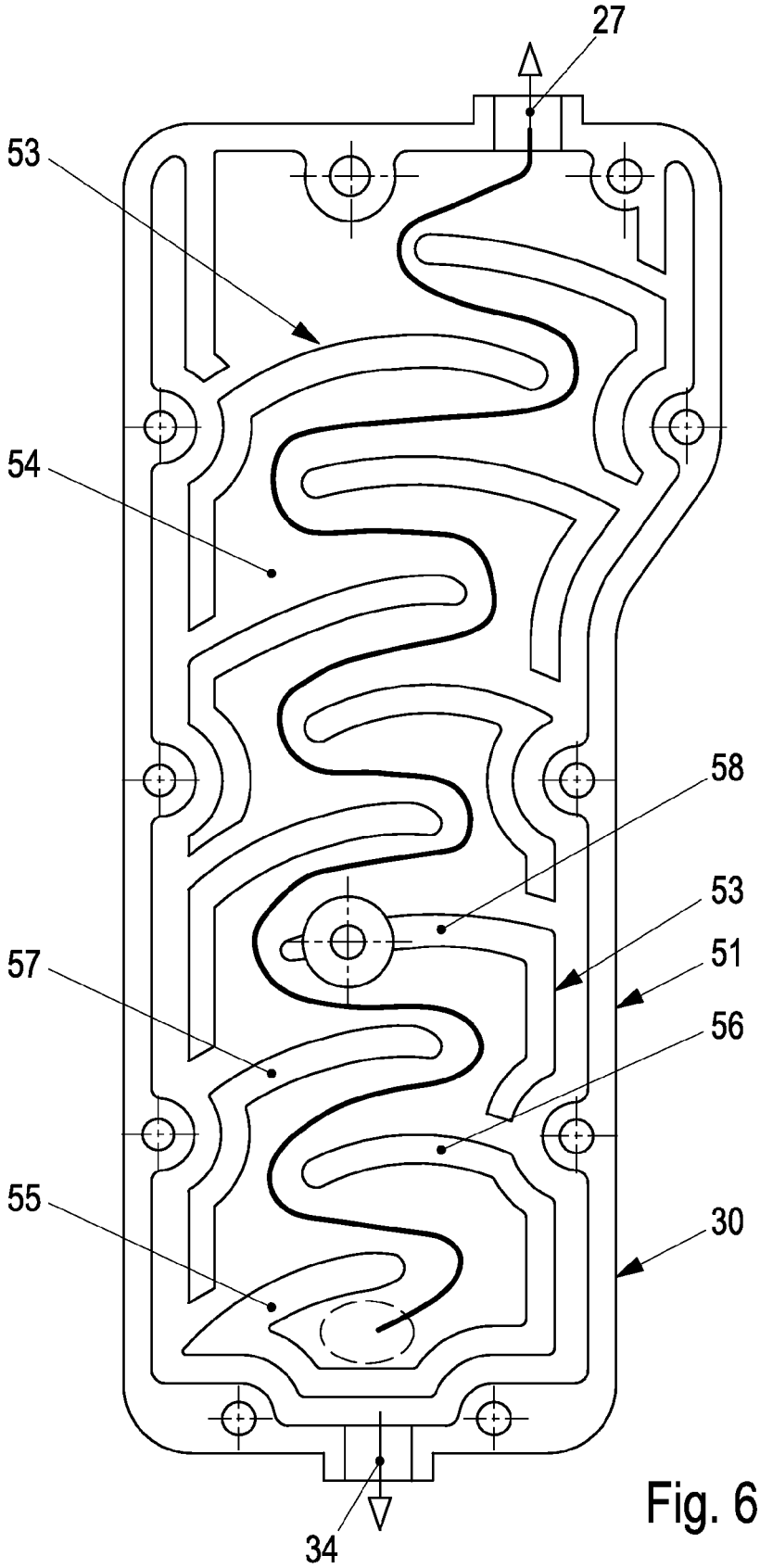
FIG. 6 shows a view in the direction of the interior side of the main oil separator having guide webs of a labyrinth.

Main oil separator 30 is provided with a labyrinth 53—FIGS. 3 and 6—along which the mixture of oil and leaking gas is guided, as a result of which, on one hand, the leak-gas is led to intake system 27 and, on the other, the oil is led to oil pan 34. Labyrinth 53 is mounted to an interior side 54 of lid 51 and is formed by spaced guide webs 55, 56 and 57, 58, which extend from upright sides 59 and 60 situated opposite of each other in a transverse manner to the longitudinal direction Lr and which have a defined inclination angle. In this instance, guide webs 55, 56 or 57, 58 interlock with one another in an alternating manner, and may be arched. It is achieved by guide webs 55, 56 or 57, 58 designed in such a manner that separated oil is channeled through discharge duct system 61 and a fifth passageway 62 into oil pan 34.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A reciprocating internal combustion engine, comprising:

at least one piston, two connecting rods operatively connecting each piston to two crankshafts rotating in opposite directions and running parallel to each other, the crankshafts being oriented in an upright manner to a horizontal water line of a boat, an internal combustion engine housing of the internal combustion engine made up of at least a cylinder crank housing and a cylinder head, having inlet and outlet valves, the internal combustion engine housing being bounded by an upper end face and a bottom end face, and a ventilation system provided for the internal combustion engine housing, the ventilation system having an oil separating device provided with an oil pre-separator and a main oil separator, wherein, when a mixture of oil and leaking gas in a crankcase of the cylinder crank housing results from engine operation, the mixture reaches the oil pre-separator by way of a discharge line extending adjacent to the upper end face, said mixture is led from the oil pre-separator into the main oil separator and there is separated into components of oil and leaking gas, the separated oil component flows into an oil pan connecting at the bottom end face, and the separated leaking gas component flows near the upper end face into an intake system of the internal combustion engine, wherein the oil pre-separator comprises at least first and second upright guiding chambers that are, at least in some areas, separated by a guiding element, in which a second passageway is provided for through-flowing the mixture of oil and leaking gas, wherein the guiding chambers and the guiding element of the oil pre-separator extend over a substantial length of the cylinder head, and wherein the second passageway is situated between the chambers adjacent to the bottom end face of the internal combustion engine housing.

2. The internal combustion engine according to claim 1, wherein the discharge line is formed by a tube element, which is placed outside of the internal combustion engine housing alongside the upper end face.

3. The internal combustion engine according to claim 1, wherein the discharge line runs into the oil pre-separator, and the mixture of oil and leaking gas flows into the oil pre-separator from a valve-camshaft area of the cylinder head adjacent to the discharge line via a first passageway between the cylinder head and the oil pre-separator.

4. The internal combustion engine according to claim 1, wherein the oil pre-separator and the main oil separator are combined into a housing structure.

5. The internal combustion engine according to claim 4, wherein the housing structure is, by way of holding screws, held in position at a cylinder head of the internal combustion engine housing.

6. The internal combustion engine according to claim 4, wherein the oil pre-separator and the main oil separator are, by inter-positioning a spacer, put together in such a manner that connecting planes run between the oil pre-separator and the spacer, and between the spacer and the main oil separator.

7. The internal combustion engine according to claim 6, wherein the oil pre-separator, the spacer and the main oil separator of the housing structure are put together by at least one connecting screw.

8. The internal combustion engine according to claim 6, wherein the at least one connecting screw is one of a plurality of connecting screws adjacent to a rim zone of the housing structure oriented approximately perpendicular to the connecting planes.

9. The internal combustion engine according to claim 6, wherein the main oil separator is designed as a lid with a circumferential connecting rim adjacent to the spacer.

10. The internal combustion engine according to claim 9, wherein the labyrinth is mounted to an interior side of the lid.

11. The internal combustion engine according to claim 1, wherein the main oil separator is provided with a labyrinth, along which the mixture of oil and leaking gas is guided, as a result of which the gas is separated from the oil so that the gas is guided in the direction of the intake system and the oil is guided in the direction of the oil pan.

12. The internal combustion engine according to claim 1, wherein the engine is an outboard engine for the boat.

13. A reciprocating internal combustion engine, comprising:

at least one piston, two connecting rods operatively connecting each piston to two crankshafts rotating in opposite directions and running parallel to each other, the crankshafts being oriented in an upright manner to a horizontal water line of a boat, an internal combustion engine housing of the internal combustion engine made up of at least a cylinder crank housing and a cylinder head, having inlet and outlet valves, the internal combustion engine housing being bounded by an upper end face and a bottom end face, and a ventilation system provided for the internal combustion engine housing, the ventilation system having an oil separating device provided with an oil pre-separator and a main oil separator, wherein, when a mixture of oil and leaking gas in a crankcase of the cylinder crank housing results from engine operation, the mixture reaches the oil pre-separator by way of a discharge line extending adjacent to the upper end face, said mixture is led from the oil pre-separator into the main oil separator and there is separated into components of oil and leaking gas, the separated oil component flows into an oil pan connecting at the bottom end face, and the separated leaking gas component flows near the upper end face into an intake system of the internal combustion engine, wherein the oil pre-separator comprises at least first and second upright guiding chambers that are, at least in some areas, separated by a guiding element, in which a second passageway is provided for through-flowing the mixture of oil and leaking gas, and wherein the mixture of oil and leaking gas in the first guiding chamber is guided from the top to the bottom between the upper end face and the bottom end face alongside the guiding element and enters through the second passageway the second chamber, via which said mixture of oil and leaking gas flows in the direction of the upper end face and from there reaches the main oil separator by inter-positioning a third passageway.

14. A reciprocating internal combustion engine, comprising:

at least one piston, two connecting rods operatively connecting each piston to two crankshafts rotating in opposite directions and running parallel to each other, the crankshafts being oriented in an upright manner to a horizontal water line of a boat, an internal combustion engine housing of the internal combustion engine made up of at least a cylinder crank housing and a cylinder head, having inlet and outlet valves, the internal combustion engine housing being bounded by an upper end face and a bottom end face, and a ventilation system provided for the internal combustion engine housing, the ventilation system having an oil separating device provided with an oil pre-separator and a main oil separator, wherein, when a mixture of oil and leaking gas in a crankcase of the cylinder crank housing results from engine operation, the mixture reaches the oil pre-separator by way of a discharge line extending adjacent to the upper end face, said mixture is led from the oil pre-separator into the main oil separator and there is separated into components of oil and leaking gas, the separated oil component flows into an oil pan connecting at the bottom end face, and the separated leaking gas component flows near the upper end face into an intake system of the internal combustion engine, wherein the main oil separator is provided with a labyrinth, along which the mixture of oil and leaking gas is guided, as a result of which the gas is separated from the oil so that the gas is guided in the direction of the intake system and the oil is guided in the direction of the oil pan, and wherein the labyrinth has spaced guide webs, which, starting from upright, opposite sides, interlock in an alternating manner and which are situated in such a manner that separated oil of the mixture of oil and leaking gas is guided by a discharge duct system in the direction of the oil pan.

15. The internal combustion engine according to claim 14, wherein the oil pre-separator comprises at least first and second upright guiding chambers that are, at least in some areas, separated by a guiding element, in which a second passageway is provided for through-flowing the mixture of oil and leaking gas.

16. The internal combustion engine according to claim 14, wherein the oil pre-separator comprises at least first and second upright guiding chambers that are, at least in some areas, separated by a guiding element, in which a second passageway is provided for through-flowing the mixture of oil and leaking gas.

17. A reciprocating internal combustion engine, comprising:

at least one piston, two connecting rods operatively connecting each piston to two crankshafts rotating in opposite directions and running parallel to each other, the crankshafts being oriented in an upright manner to a horizontal water line of a boat, an internal combustion engine housing of the internal combustion engine made up of at least a cylinder crank housing and a cylinder head, having inlet and outlet valves, the internal combustion engine housing being bounded by an upper end face and a bottom end face, and a ventilation system provided for the internal combustion engine housing, the ventilation system having an oil separating device provided with an oil pre-separator and a main oil separator, wherein, when a mixture of oil and leaking gas in a crankcase of the cylinder crank housing results from engine operation, the mixture reaches the oil pre-separator by way of a discharge line extending adjacent to the upper end face, said mixture is led from the oil pre-separator into the main oil separator and there is separated into components of oil and leaking gas, the separated oil component flows into an oil pan connecting at the bottom end face, and the separated leaking gas component flows near the upper end face into an intake system of the internal combustion engine, wherein the discharge line runs into the oil pre-separator, and the mixture of oil and leaking gas flows into the oil pre-separator from a valve-camshaft area of the cylinder head adjacent to the discharge line via a first passageway between the cylinder head and the oil pre-separator, wherein the oil pre-separator comprises at least first and second upright guiding chambers that are, at least in some areas, separated by a guiding element, in which a second passageway is provided for through-flowing the mixture of oil and leaking gas, and wherein the guiding chambers and the guiding element of the oil pre-separator extend over a substantial length of the cylinder head, and wherein the second passageway is situated between the chambers adjacent to the bottom end face of the internal combustion engine housing.

18. The internal combustion engine according to claim 17, wherein the mixture of oil and leaking gas in the first guiding chamber is guided from the top to the bottom between the upper end face and the bottom end face alongside the guiding element and enters through the second passageway the second chamber, via which said mixture of oil and leaking gas flows in the direction of the upper end face and from there reaches the main oil separator by inter-positioning a third passageway.

19. The internal combustion engine according to claim 17, wherein the oil pre-separator and the main oil separator are combined into a housing structure.

* * * * *